US012390711B2

(12) United States Patent
Kalfa

(10) Patent No.: US 12,390,711 B2
(45) Date of Patent: Aug. 19, 2025

(54) TURNING DEVICE FOR A BALL LAUNCHER

(71) Applicant: SLINGER BAG LTD, Ra'anana (IL)

(72) Inventor: Yonah Kalfa, Ra'anana (IL)

(73) Assignee: SLINGER BAG LTD, Ra'anana (IL)

( * ) Notice: Subject to any disclaimer, the term of this patent is extended or adjusted under 35 U.S.C. 154(b) by 3 days.

(21) Appl. No.: 17/635,681

(22) PCT Filed: Aug. 12, 2020

(86) PCT No.: PCT/IL2020/050881
§ 371 (c)(1),
(2) Date: Feb. 15, 2022

(87) PCT Pub. No.: WO2021/028914
PCT Pub. Date: Feb. 18, 2021

(65) Prior Publication Data

US 2022/0296982 A1 Sep. 22, 2022

(30) Foreign Application Priority Data

Aug. 15, 2019 (IL) ..... 268727

(51) Int. Cl.
*A63B 69/40* (2006.01)
*A47B 11/00* (2006.01)
(Continued)

(52) U.S. Cl.
CPC ..... *A63B 71/023* (2013.01); *A47B 11/00* (2013.01); *A63B 69/40* (2013.01);
(Continued)

(58) Field of Classification Search
CPC .... B64F 1/04; F41F 3/04; A63B 69/40; A63B 69/38; A63B 71/023; A63B 71/0622;
(Continued)

(56) References Cited

U.S. PATENT DOCUMENTS 1,417,384 A * 5/1922 Imler ..... B60S 13/02 104/44
3,757,759 A * 9/1973 Haworth ..... A63B 69/408 124/82
(Continued)

FOREIGN PATENT DOCUMENTS

CN 202961799 U 6/2013
CN 104689549 A 6/2015
(Continued)

OTHER PUBLICATIONS

Chinese Office Action and Search Report, China National Intellectual Property Administration Patent Application No. 202080064695.3, dated Aug. 23, 2022, 14 pages.
(Continued)

*Primary Examiner* — John E Simms, Jr.
(74) *Attorney, Agent, or Firm* — Fenwick & West LLP

(57) ABSTRACT

A ball launcher turning device external to the ball launcher comprises a base, a platform movably connected to said base and externally securable to the ball launcher, and a turning mechanism housed within the turning device that is configured to cause the platform and the ball launcher to undergo angular displacement relative to the base, in response to a force transmitted to the turning mechanism by a controlled force generator, to facilitate propulsion of balls ejected from the ball launcher in varying directions.

16 Claims, 7 Drawing Sheets

(51) Int. Cl.

| | |
|---|---|
| ***A63B 71/02*** | (2006.01) |
| *A63B 71/06* | (2006.01) |
| *A63B 102/02* | (2015.01) |
| *A63B 102/08* | (2015.01) |
| *A63B 102/14* | (2015.01) |
| *A63B 102/18* | (2015.01) |
| *A63B 102/20* | (2015.01) |

(52) U.S. Cl.
CPC ... *A63B 2069/401* (2013.01); *A63B 2071/025* (2013.01); *A63B 2071/0683* (2013.01); *A63B 2102/02* (2015.10); *A63B 2102/08* (2015.10); *A63B 2102/14* (2015.10); *A63B 2102/18* (2015.10); *A63B 2102/182* (2015.10); *A63B 2102/20* (2015.10); *A63B 2209/08* (2013.01); *A63B 2225/50* (2013.01); *A63B 2225/74* (2020.08)

(58) Field of Classification Search
CPC ..... A63B 2071/025; A63B 2071/0683; A63B 2071/024; A63B 2102/02; A63B 2102/08; A63B 2102/14; A63B 2102/18; A63B 2102/182; A63B 2102/20; A47B 11/00
See application file for complete search history.

(56) References Cited

U.S. PATENT DOCUMENTS

| | | | | |
|---|---|---|---|---|
| 4,116,438 | A * | 9/1978 | Berliner | A63B 69/406 473/436 |
| 4,207,857 | A * | 6/1980 | Balka, Jr. | A63B 69/409 124/56 |
| 4,765,618 | A * | 8/1988 | Daley | A63B 69/406 124/78 |
| 4,834,060 | A * | 5/1989 | Greene | A63B 69/406 124/78 |
| 6,231,020 | B1 * | 5/2001 | Willson | F16M 11/08 248/922 |
| 6,568,646 | B2 * | 5/2003 | Wess | A61G 5/1054 248/349.1 |
| 7,028,968 | B2 * | 4/2006 | Washick | A47G 33/126 248/521 |
| 7,040,248 | B1 * | 5/2006 | Whitfield | B63B 29/06 114/364 |
| 2005/0076436 | A1 * | 4/2005 | Hahn | A61G 7/1046 5/81.1 R |
| 2006/0054770 | A1 * | 3/2006 | Lansdown | F16M 11/08 248/349.1 |
| 2013/0104870 | A1 * | 5/2013 | Rizzo | A63B 69/38 124/78 |
| 2014/0121043 | A1 * | 5/2014 | Blanning | A63B 69/40 473/459 |
| 2019/0059327 | A1 * | 2/2019 | So | A01K 15/025 |
| 2021/0190452 | A1 * | 6/2021 | Jeannot | F41A 23/42 |

FOREIGN PATENT DOCUMENTS

| | | | |
|---|---|---|---|
| CN | 108325197 | A | 7/2018 |
| CN | 108671518 | A | 10/2018 |
| CN | 208553056 | U | 3/2019 |
| EP | 0353234 | B1 | 6/1994 |
| JP | S56-176771 | U | 12/1981 |
| JP | S59-161869 | U | 10/1984 |
| JP | H09-262331 | A | 10/1997 |
| JP | 2000-245887 | A | 9/2000 |
| TW | 200918130 | A | 5/2009 |
| WO | WO 2019/106647 | A1 | 6/2019 |

OTHER PUBLICATIONS

Extended European Search Report, European Patent Application No. 20852235.9, dated Sep. 1, 2022, 12 pages.
PCT International Search Report and Written Opinion, PCT Application No. PCT/IL2020/050881, Nov. 24, 2020, 10 pages.
Japan Patent Office, Office Action, JP Patent Application No. 2022-509611, May 27, 2024, six pages.

* cited by examiner

TURNING DEVICE FOR A BALL LAUNCHER

FIELD OF THE INVENTION

The present invention is in the field of sports practice accessories. More specifically, the invention relates to a turning device, which can be used with automated ball launchers, such as tennis ball launchers.

BACKGROUND OF THE INVENTION

An important element in sports training practice is the preparation of a player for a match against an opponent by simulating a match, in particular a tennis match, by employing an automatic ball launcher.

While several automatic ball launchers are commercially available in the market, they either include sophisticated and expensive products, or they include basic launchers that may require unwieldy manual operations, such as manual aiming of the launcher to different areas of court. Having a simple rotation device for basic ball launchers, such as not including an integral automated maneuvering mechanism, would be of a great advantage for reducing the costs of tennis practice.

It is therefore an object of the present invention to provide a cost effective turning device for available tennis ball launchers, including automated ball launchers.

It is another object of the invention to provide a comfortably and conveniently transportable ball launcher turning device.

Other objects and advantages of the invention will become apparent as the description proceeds.

SUMMARY OF THE INVENTION

A ball launcher turning device external to the ball launcher comprises a base, a platform movably connected to said base and externally securable to the ball launcher, and a turning mechanism housed within said turning device that is configured to cause said platform and the ball launcher to undergo angular displacement relative to said base, in response to a force transmitted to said turning mechanism by a controlled force generator, to facilitate propulsion of balls ejected from the ball launcher in varying directions.

In one aspect, the platform is configured to undergo angular displacement with respect to the base about a vertically oriented pin movably connecting the platform and the base.

In one aspect, the turning mechanism is movably connected to the platform, and may also be movably connected to the force generator.

In one aspect, the turning mechanism transmits a force that causes the platform to undergo oscillatory angular displacement, or alternatively a force that causes the platform to undergo irregular angular displacement.

In one aspect, the turning device further comprises guide means linked to one or more elements of the turning mechanism, to ensure that the platform will be guided along a desired path during the angular displacement.

In one aspect, the turning device further comprises the force generator which is also housed within the turning device, wherein a power source for powering the force generator is connectable thereto.

The force generator may be an electric motor, while the power source is selected from the group consisting of an AC electricity supply system deliverable to the motor by an electrical outlet and a cable connected to the outlet and to the motor, an external battery, and an internal rechargeable battery. The power source is able to provide steady electric power that is sufficient to start and stop the angular displacement of the platform. Alternatively, the power source is able to provide a controllable current level that is sufficient to start and stop the angular displacement of the platform and to control its rotational speed.

In one aspect, the turning device further comprises an internal controller which is also housed within the turning device and is configured to control operation of the force generator, wherein the internal controller has at least one communication unit, for receiving operational commands from at least one remote station. The at least one communication unit is selected from the group consisting of a Bluetooth device, a WiFi device, a wired communication device, and a combination thereof. The at least one remote station is selected from the group consisting of a smartphone, a tablet, a computer, a remote controller, and a combination thereof.

In one aspect, one or more contact wheels adapted to be in rolling contact with an underside of the platform are movably mounted to the base to maintain a substantially uniform spacing between the base and platform, while the platform is both stationary and undergoing angular displacement.

In one aspect, the base or platform is configured with a plurality of structural supports providing increased structural integrity.

In one aspect, the turning mechanism comprises an elongated link that is pivotally connected at a first end to a vertically oriented shaft driven by the force generator and that is slidably constrained at a second end within a groove formed in the platform that is offset from the shaft to apply a rotation-inducing force. The groove is linearly extending and is delimited by first and second parallel walls, a relative position of the second end of the link defining onto which of the first and second walls is the rotation-inducing force applied thereby and also defining a corresponding turning direction of the platform.

A combination of a ball launcher and a ball launcher turning device comprises a ball launcher and the turning device.

In one aspect, the combination further comprises securing means by which the ball launcher is securable to the turning device.

In one aspect, the securing means are configured as hand-manipulated elements.

In one aspect, the securing means are recessed regions formed in the platform that are shaped to receive corresponding elements of the ball launcher and that are configured to minimize or altogether eliminate ball launcher slippage during the angular displacement. The corresponding elements of the ball launcher generally include portability-facilitating bottom wheels.

In one aspect, the turning device comprises an electric motor for transmitting a force to the turning mechanism, and the ball launcher comprises a battery for powering the motor as well as ball launcher components, electrical power being transmittable through a cable extending between, and releasably connected to, the battery and the turning device motor.

In one aspect, a controller in data communication with the ball launcher components is housed within the ball launcher and comprises a processor configured to transmit control signals needed to initiate a desired ball ejection operation to the turning device motor, through the cable. The turning device mechanism has different rotational characteristics during initiation of two subsequent ball ejection operations that are performed in response to first and second different control signals.

In one aspect, the controller is also in data communication with a user interface by which desired operating conditions for the turning mechanism motor are settable.

DETAILED DESCRIPTION OF THE INVENTION

The present invention relates to a turning device, having a base and a rotatable platform utilized for repeatedly turning an overlying tennis ball launcher right and left, so that the balls ejected from the launcher will be directed to different areas of a tennis court surface, thereby challenging a tennis beginner or other more advanced players interested in improving their stroke and body positioning with respect to incoming balls that are able to fall in different parts of the court.

Some prior art tennis ball launchers have an oscillating function; however, the prior art oscillating apparatus is built-in to the launcher and therefore considerably adds weight to the launcher, reducing portability, and additionally adds unwanted costs. Additionally, the ball launcher will be rendered inoperable if the prior art oscillating apparatus malfunctions.

Figure 4:
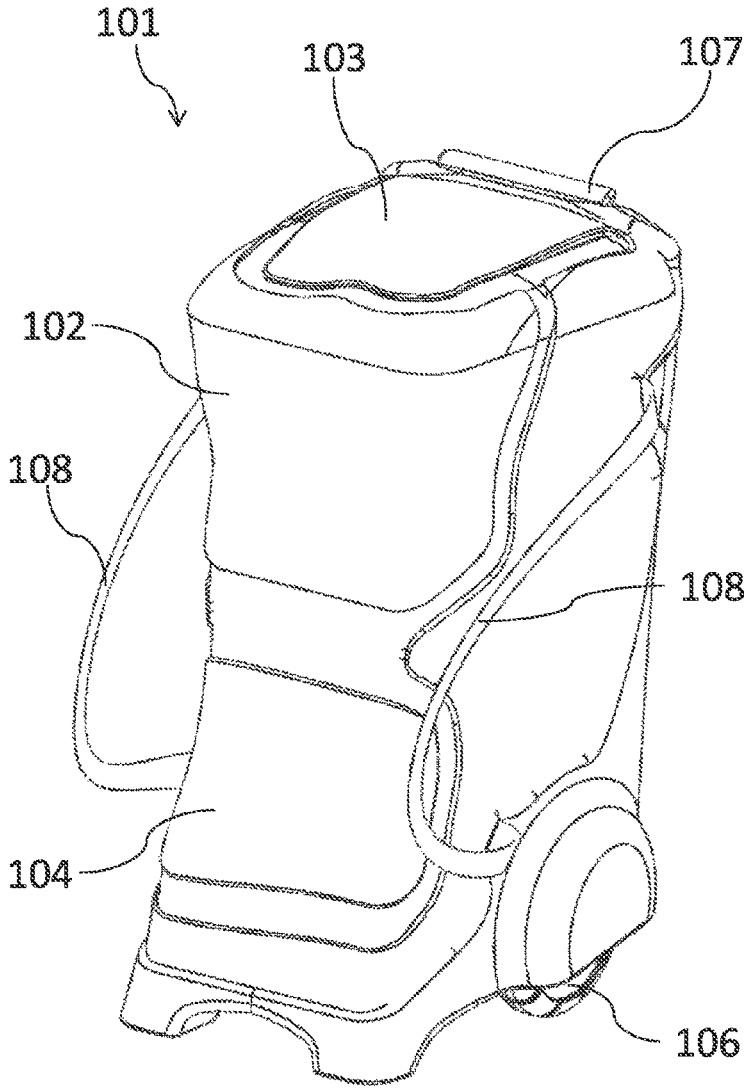
FIG. 4 is a perspective view of an exemplary ball launcher which is able to be turned by the turning device of FIG. 1, shown when a ball ejection port and user interface are covered.

The turning device of the present invention comprising a turning mechanism, which is configured as a device separate from the ball launcher, is adapted to cooperate not only with the ball launcher 101 described in WO 2019/106647 by the same Applicant, which is illustrated in FIG. 4 and is configured with bottom support wheels 106, an extendable handle 107, shoulder straps 108, a plurality of compartments 102-104 including one for accommodating sport equipment, an integrated hopper and automatic launching apparatus for increased portability and compactness, but also with other types of ball launchers. A player is advantageously able to continue a training session to improve stroke techniques with the ball launcher even if the turning device unexpectedly malfunctions.

Although the following description relates to a device that cooperates with apparatus for the launching of tennis balls, the device is similarly suitable for the launching of other types of balls, such as pickleballs, paddle balls, soft tennis balls, baseballs, softballs, cricket balls and lacrosse balls.

Reference will now be made to several embodiments of the present invention, examples of which are shown in the accompanying figures for illustration. One skilled in the art will readily recognize from the following description that alternative elements may be employed without departing from the principles of claimed invention.

Figure 6:
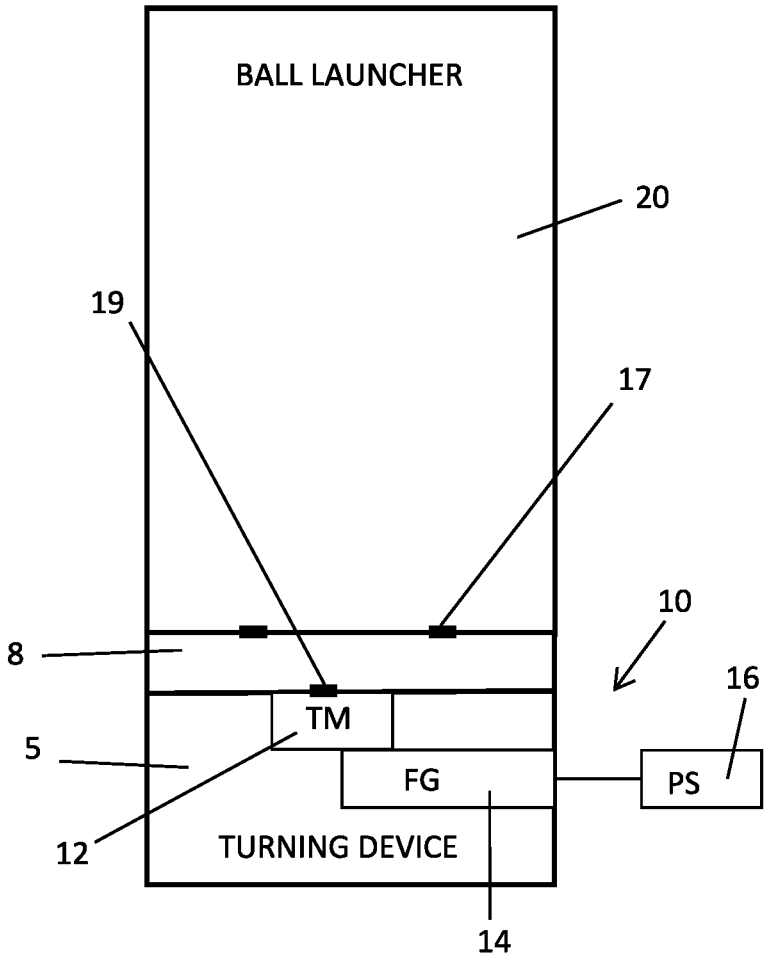
FIG. 6 is a schematic illustration of an embodiment of a turning device to which a ball launcher is secured.

As an introduction, FIG. 6 schematically illustrates a ball launcher turning device 10. Turning device 10 comprises a base 5, and a platform 8 movably connected to base 5 for securing a ball launcher 20 by securing means 17. Turning device 10 has a significantly smaller height than ball launcher 20, generally a fraction of the ball launcher height ranging from one-thirtieth to one-third the height of ball launcher 20, or any other suitable fraction, and a correspondingly smaller weight, so that it can be conveniently carried in one's arm.

A turning mechanism (TM) 12 housed within turning device 10 produces angular displacement, in response to a force transmitted thereto by a controlled force generator (FG) 14, which may be external to base 5, of platform 8 relative to base 5 to cause in turn angular displacement of ball launcher 20 relative to base 5, so that balls will be propelled in varying directions. Securing means 17 may be hand-manipulated elements such as clamps and straps, or, alternatively, may be recessed regions formed in platform 8 that are complementary or otherwise shaped to receive corresponding elements of ball launcher 20 with or without engagement with a wall of a recessed region, which are configured to minimize or altogether eliminate ball launcher slippage during the turning motion.

Turning mechanism 12 may be movably connected to platform 8, base 5, or to both base 5 and platform 8, to provide oscillatory angular displacement or, alternatively, irregular angular displacement. Guide means 19 linked to one or more elements of turning mechanism 12 ensures that platform 8 will be guided along a desired path during the angular displacement.

The angular displacement, which is generally initiated about a vertical axis but which may also be initiated about an axis oblique to a vertical axis, may be directed periodically both to a right side and to a left side, or may directed only to a right side or only to a left side.

Turning mechanism 12 may be any mechanism well known to those skilled in the art such as a crank mechanism, a cam based mechanism, a four bar linkage, a mechanism comprising a revolute joint, and a mechanism comprising a prismatic joint, or may be any other suitable mechanism.

Force generator 14 generally outputs the transmitted force in conjunction with a power source (PS) 16, which may be positioned externally to base 5, by user friendly electrical or electronic actuation, but may also be output by pneumatic or hydraulic means.

Figure 1:
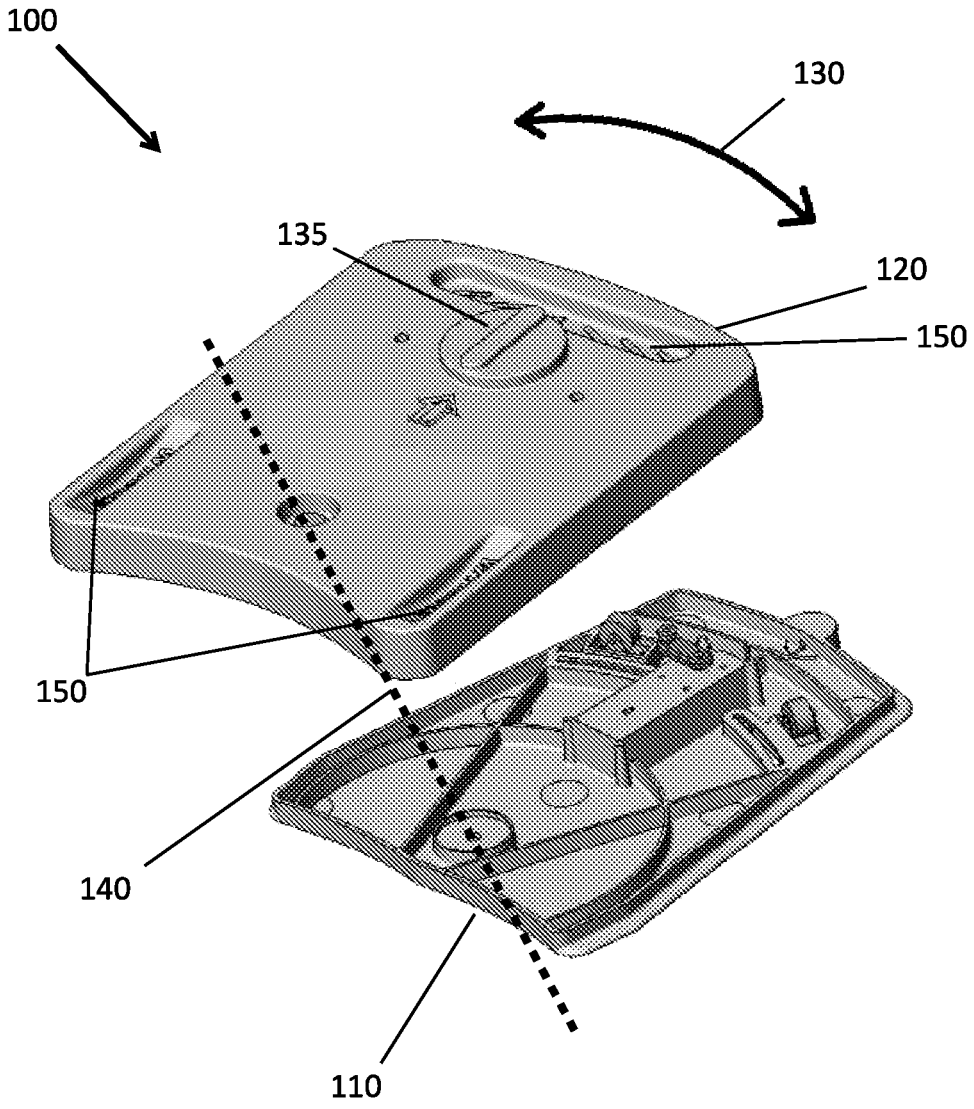
FIG. 1 is a schematic illustration of an embodiment of a ball launcher turning device, shown in exploded view.
Figure 2A:
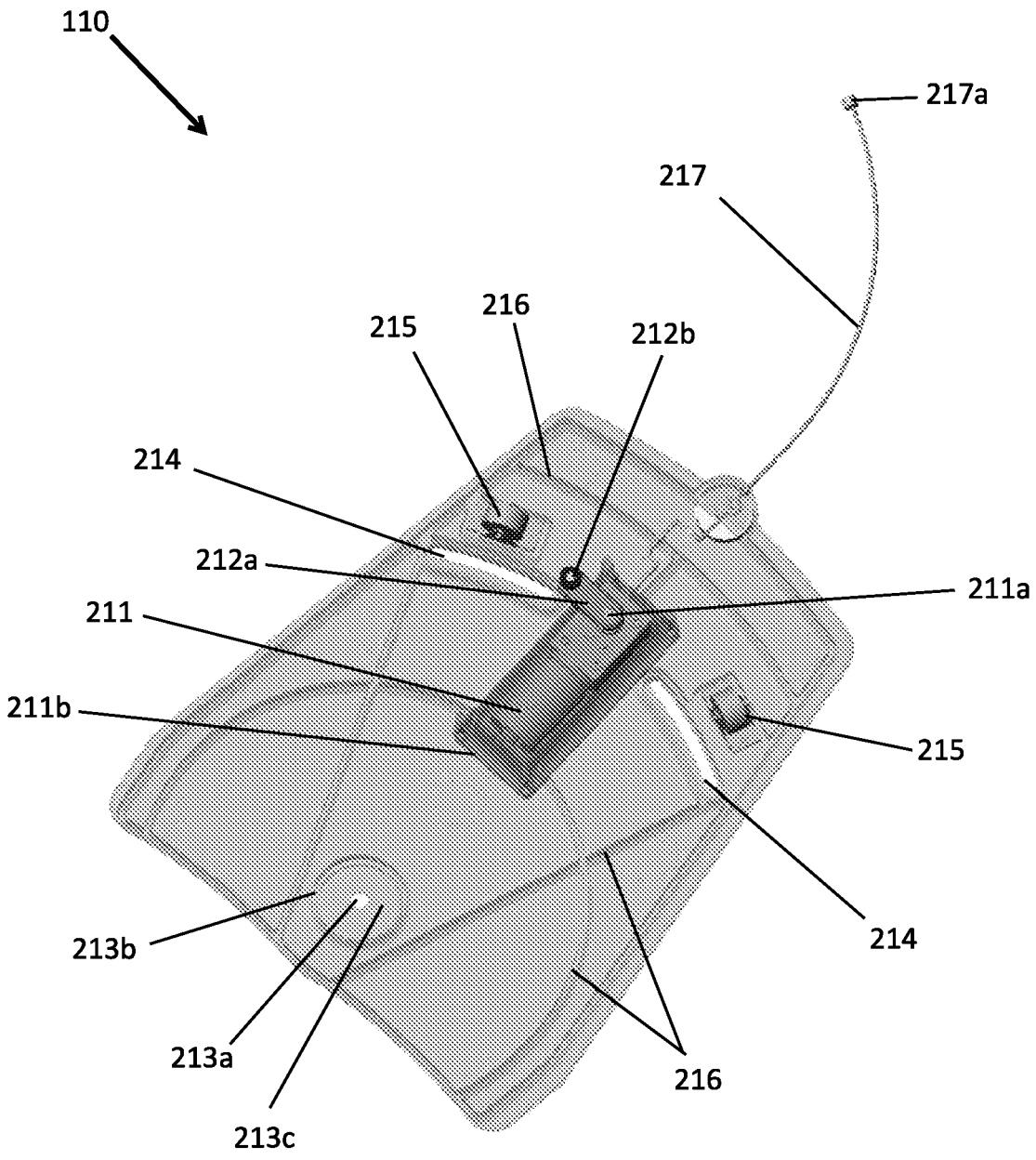
FIG. 2A is a perspective top view of a base used in conjunction with the turning device of FIG. 1.
Figure 2B:
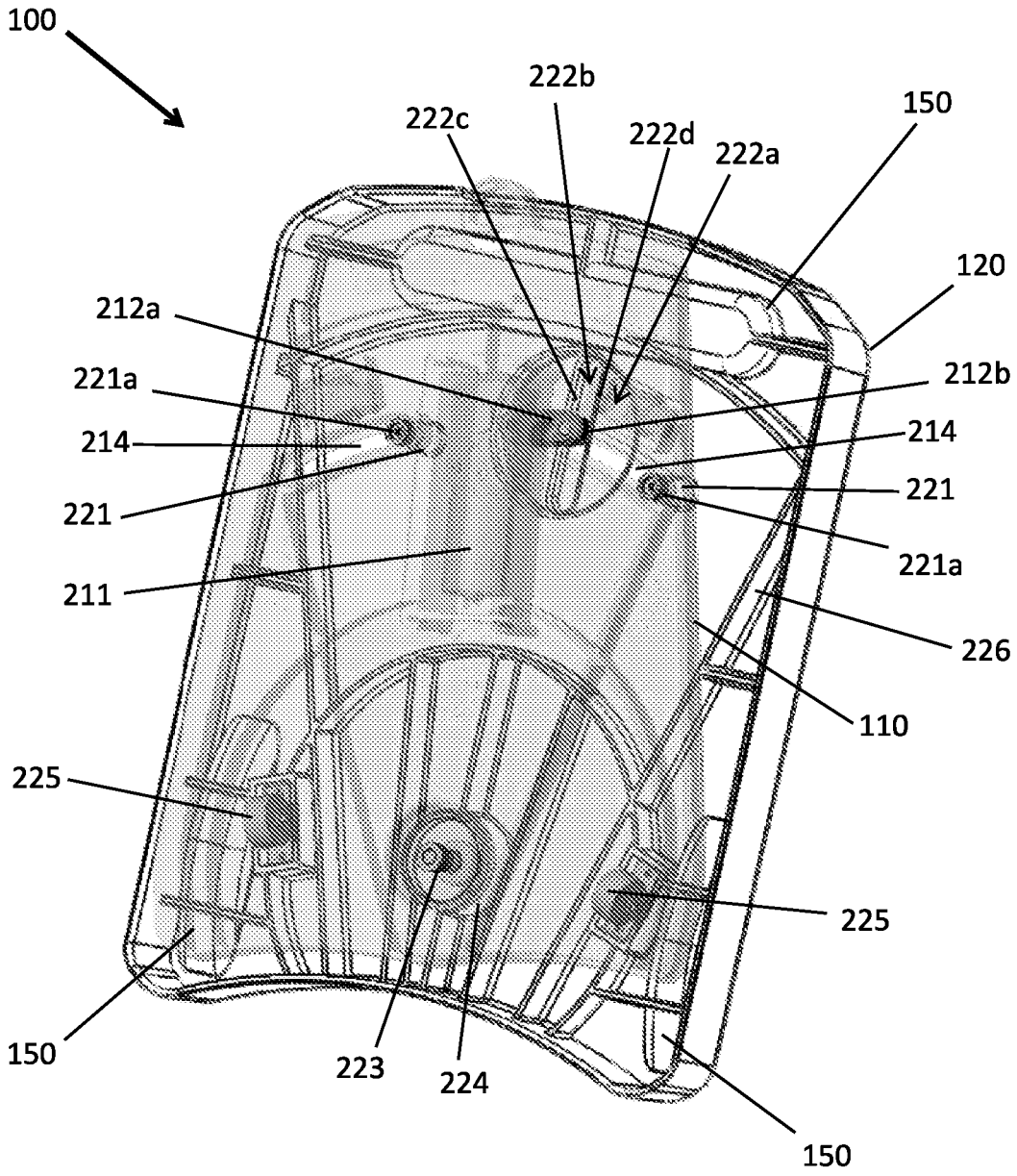
FIG. 2B is a bottom perspective view of the turning device of FIG. 1, while the base shown to be partially transparent.
Figure 3:
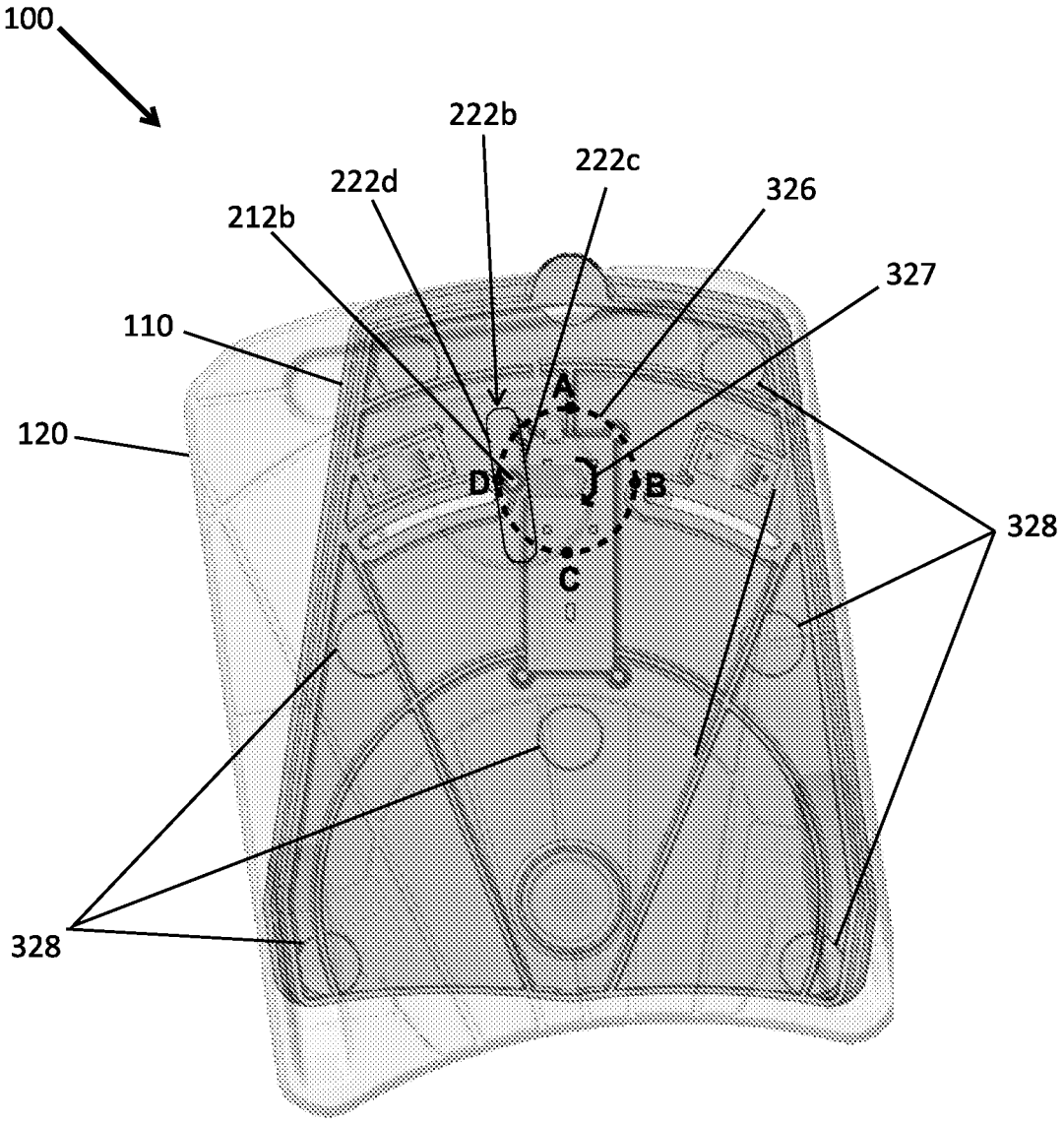
FIG. 3 is a top view of the turning device of FIG. 1, while the platform is shown to be partially transparent and rotation of the turning mechanism is schematically illustrated.

FIGS. 1-3 illustrate a turning device 100 according to one embodiment wherein the rotatable platform 120 undergoes horizontal oscillatory angular displacement (marked as an arcuate arrow 130 in FIG. 1) with respect to base 110, about vertical axis 140 (marked as a dashed line). Platform 120 is able to rotate in conjunction with the turning mechanism at a constant and cyclical slow rate, for example at 3.7 rpm or any other controlled speed, both in the right direction and in the left direction, after activation device 135, such as a knob, is actuated. Activation device 135 shown to be provided with platform 120 may be able to set the turning mechanism to a single speed, or, alternatively, one of many speeds.

The turning mechanism includes an elongated and constrained rotatable element. Although the invention is not limited to the example illustrated in this embodiment, one end of the rotatable element is pivotally connected by a pivot about which the rotatable element rotates, and the second end of the rotatable element is slidably constrained within a groove that is offset from the pivot. During operation of the turning mechanism by an electric motor, the constrained second end apples a rotation-inducing force to platform 120.

Base 110 is shown in FIG. 1 to be configured with positioning depressions 150 used for a stable placement of a tennis ball launcher on top of platform 120, to ensure tennis ball launcher stability during the turning motion of platform 120. These positioning depressions 150 are well suited for interaction with ball launcher 101 of FIG. 4, wherein the bottom wheels are adapted to be received within the rear depressions and a bottom handle underlying a lower surface of the launcher (not shown) is adapted to be received within the from depression. Of course, other combinations of a ball launcher and a turning device are within the scope of the invention.

Although device 100 is shown to have a substantially rectangular shape, it will be appreciated that other shapes as well are within the scope of the invention.

FIG. 2A illustrates a detailed top view of base 110 when separated from the platform. An electrical motor 211, generally a gear motor, is symmetrically mounted onto base 110, along a midline thereof. An outlet shaft 211*a*, onto which a proximal end of a link 212*a*, e.g. an elliptical link, is threaded or otherwise pivotally connected, while having a freely rotatable actuator wheel 212*b* connected to its distal or second end, is substantially perpendicular to the longitudinal axis of motor 211. Electrical motor 211 is installed within a suitable compartment 211*b* (partially sectioned in FIG. 2A for the sake of clarity) and generates the controlled force that is transmitted through shaft 211*a* in order to pivotally drive link 212*a* at a constant rate.

Base 110 is configured with means for supporting a pin joint rotatably connecting base 110 and platform 120 and constituting the center of rotation of the platform. Such means include a surface which is recessed with respect to a border 213*b*, e.g. circular, and formed with an aperture 213*a* at its center, which may be aligned with the longitudinal axis of motor 211. This surface together with a corresponding recessed surface of platform 120 defines a spacer cavity 213*c* for a low friction spacer (e.g., a Teflon shim which reduces the friction between rotating platform 120 of FIG. 1 and base 110). Base 110 also has two arcuate guiding sockets 214, which may be thin through-hole apertures. The combination of the pin joint and guiding sockets 214 defines the rotation path of platform 120 with respect to base 110.

Further shown in FIG. 2A are two contact wheels 215 movably mounted to base 110 adjacent to a corresponding guiding socket 214 and adapted to be in rolling contact with the underside of platform 120, which maintain a substantially uniform spacing between the base and platform, while the platform is both stationary and undergoing angular motion. A plurality of structural supports 216, which may be of a linear and/or circular shape as shown, provide improved structural integrity and a smooth operation of the oscillated turning device.

The required electric power for operating electrical motor 211 is provided through power supply cable 217 having a connector 217*a*. According to different embodiments of the present invention, cable 217 may be connected to one of different power sources, such as a utility electrical outlet, an external battery, an internal rechargeable battery, or a controlled power outlet of an automated tennis ball launcher, through which a steady power supply is provided, or a controlled power supply (e.g., of a controlled current) is provided for controlling the rotational speed of motor 211, which in turn defines the turning speed of the platform and the starting/stopping duration for a rotation cycler. According to some embodiments, the device is provided with an internal controller and at least one communication unit (e.g., Bluetooth, Wi-Fi or wired communication devices), which receive operational commands (i.e., on/off and turning speed) from at least one remote station such as a smartphone, a tablet, a computer, or a remote control device.

FIG. 2B schematically illustrates a bottom view of device 100, showing a detailed view of rotating platform 120 behind partially transparent base 110, wherein platform 120 comprises arcuate guiding elements 221 with locking nuts 221*a* (i.e., guiding elements 221 are aligned with grooves 214 of base 210, and nuts 221*a* are threaded into elements 221, thus movably clamping the margins of grooves 214), and a rotation cavity 222*a* with a socket 222*b*, where rotation cavity 222*a* allows the sufficient space for a free rotation of link 212*a*, which rotates in a crankshaft motion, in which actuator wheel 212*b* linearly travels between the two separate ends of elongated socket 222*b*, while alternately pushing walls 222*c* and 222*d* of socket 222*b* (i.e., left and right) in accordance with an instantaneous rotational angle of link 212*a*, as will be further illustrated in FIG. 3, thus forcing the oscillated turning of platform 120.

Further shown in FIG. 2B is a pin 223 connecting base 110 and platform 120, a recessed surface 224 corresponding to the recessed surface of base 110 shown in FIG. 2A (i.e., for accommodating a low friction spacer), contact wheels 225 and structural supports 226 which provides smooth operation and structural integrity similarly to contact wheels 215 and structural supports 216 of base 110, and the opposite side of positioning depressions 150 (FIG. 1).

FIG. 3 schematically illustrates the rotation of link 212*a* (indicated in FIG. 2A). For illustration purposes, a dashed turning circle 326 is shown with positioning points A, B, C and D that traces the position of actuator wheel 212*b* while link 212*a* is continuously rotated. Although portions of turning circle 326 are shown to be outside of socket 222*b*, it will be appreciated that actuator wheel 212*b* continues to be constrained within elongated socket 222*b* throughout the range of travel of link 212*a*, while linearly sliding therealong. Socket 22*b* is therefore carried by actuator wheel 212*b* during rotation of link 212*a* to facilitate the angular displacement of platform 120.

The relative position of actuator wheel 212*b* defines onto which of walls 222*c* and 222*d* of socket 222*b* is a force applied thereby and therefore the corresponding turning direction of platform 120. According to the illustrated orientation, during clockwise rotation (indicated by arrow 327) of link 212*a* from point D to point A, actuator wheel 212*b* applies a force onto wall 222*c* towards the right, thus turning platform 220 in a similar direction, so that tennis balls will be propelled at a desired direction towards the player. In response to the further clockwise rotation of link 212*a*, from point A to point B, actuator wheel 212*b* continues to apply a force onto wall 222*c* to the right, causing platform 220 to additionally turn to the right. However, the further clockwise rotation of link 212*a*, from point B to point C, causes actuator wheel 212*b* to apply a force onto wall 222*d* to the left, thus turning platform 220 in a similar direction, and the further clockwise rotation of link 212*a*, from point C to point D, causes actuator wheel 212*b* to continue applying a force onto wall 222*d* towards the left, thus additionally turning platform 220 to the left.

Further shown in FIG. 3 are round protruding portions 328 in base 110, which are used for placing high friction supports, such as rubber plates (i.e., for stabilizing device 100 on a relatively flat training surface (e.g., for indoor training on a court floor), or anchoring studs (e.g., for an outdoor grass or clay training surface).

In another embodiment, the platform is caused to be angularly displaced at a varied rate and for a varied angular distance, so that the balls being ejected by the ball launcher will appear to be propelled in random directions. The player undergoing a training session is therefore challenged to react to the balls that are propelled in these different directions, and accordingly is able to perfect his or her coordination and stroke techniques during varying reaction times since the player cannot anticipate at which direction the ball will be propelled. Depending on the type of ball launcher secured to the platform that is able to able to condition the characteristics of the ejected ball while being propelled, the player is also unable to anticipate the speed and type of spin of the propelled ball. The timing of ball ejection from the ball launcher is also able to be synchronized with the turning characteristics of the platform.

As described above, the turning characteristics of the platform are dependent upon those of link 212*a*, or of any other turning mechanism. When an electric motor 211 is employed, the supplied electrical power as well as the control signals input thereto via cable 217 (FIG. 2A) are able to be controlled and varied.

Figure 5:
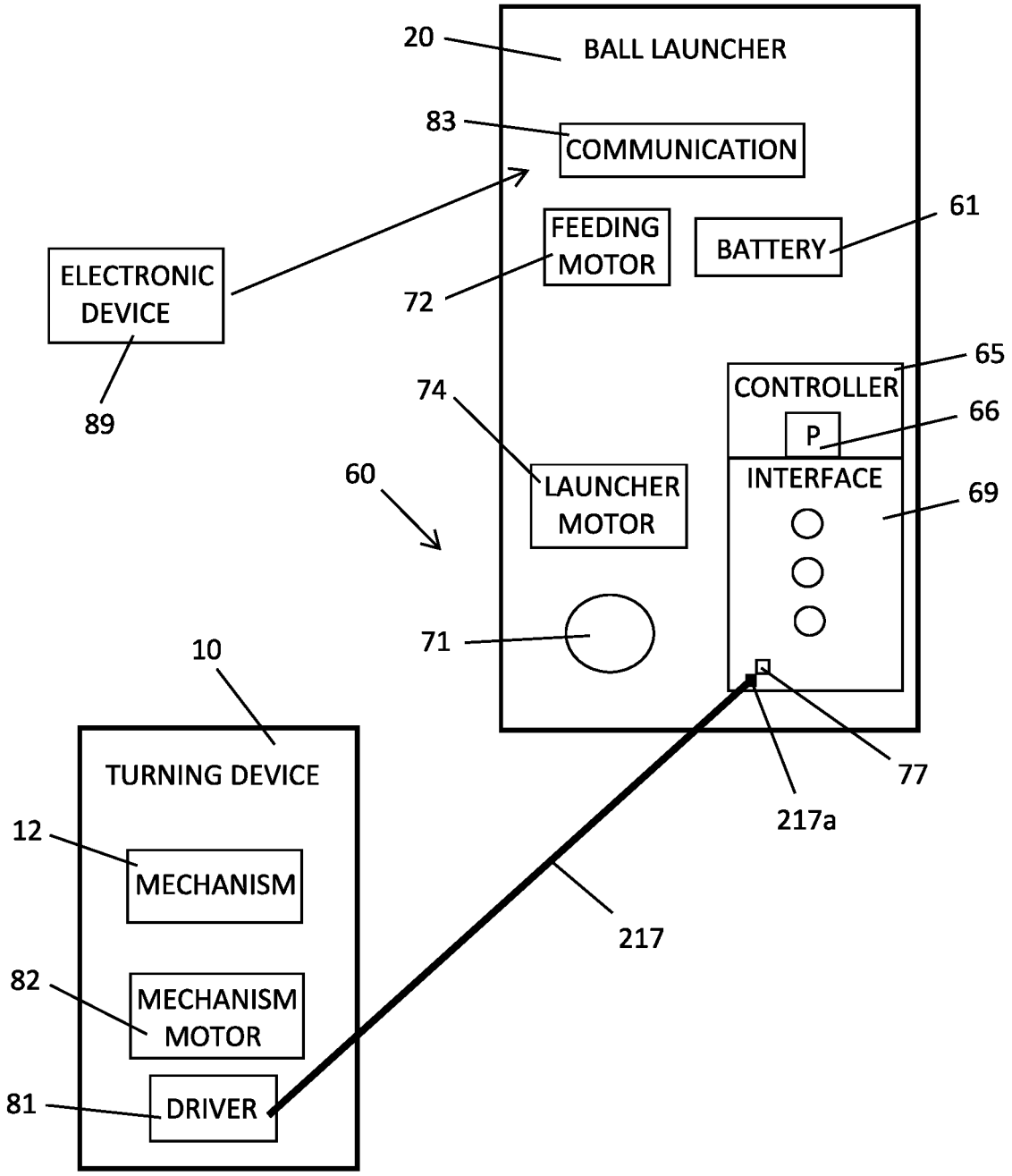
FIG. 5 is a schematic illustration of a turning mechanism control system.

FIG. 5 schematically illustrates a control system 60 that may be employed for controllably driving turning mechanism 12 being housed within turning device 10. Control system 60 comprises controller 65 housed within ball launcher 20, which is in data communication with various controlled components of the ball launcher such as a ball feeding motor 72 and a launcher motor 74, and with user interface 69 by which a user inputs desired operating conditions for ball feeding motor 72, launcher motor 74 and turning mechanism motor 82. These components are powered by battery 61, also housed within ball launcher 20. Controller 65 comprises processor (P) 66 that is data communication with the driver 81 of turning mechanism motor 82, to transmit thereto user or factory defined control signals needed to initiate a desired ball ejection operation. Alternatively, controller 65 is configured with circuitry to convert a low-current control signal output from processor 66 into a higher-current signal that can drive turning mechanism motor 82 without need of a separate driver.

The user is able to enter desired operating conditions for turning mechanism motor 82 via user interface 69 which is able to produce a rigorous training program that may not be easily remembered and will therefore help to perfect a player's skills when having to react to a propelled ball. The training program includes a plurality of ball ejection operations, and for each of which a ball may be programmed to be propelled in midair with different flight characteristics. The flight characteristics of a propelled ball are defined by the speed, spin type, if at all, and angle relative to the horizontal plane of a ball when ejected from an ejection port 71 of ball launcher 20 by launcher motor 74, and by the instantaneous speed and angle of the platform relative to the vertical plane at the time of ball ejection.

User interface 69 may be an analog interface having knobs to set the speed of each of ball feeding motor 72 and launcher motor 74, or may be a digital interface. Ball feeding motor 72 defines the frequency of the ball ejection. A LED indicator may be illuminated when the turning device is in operation. The speed in coupling the turning device to the ball launcher may be increased when user interface 69 has a magnetic port 77, which is capable of being magnetically and electrically coupled with connector 217*a* of cable 217 when made of a dedicated configuration.

To supplement user interface 69, a wireless communication module 83 in data communication with controller 65 may be in use. The operating conditions are able to be wirelessly and remotely transmitted to communication module 83 by means of an electronic device 89, such as a remote control device, smartphone, PDA, and tablet. A remote control device, for example, may be configured with a first section for the ball launcher and a second section for the turning device. Each of the first and second sections may have three or less buttons for user friendly control.

It will be appreciated that in another embodiment, controller 65 may be an internal controller housed within turning device 10, and electronic device 89 may wirelessly transmit to communication module 83, also housed within turning device 10, signals representative of the desired operating conditions.

Although embodiments of the invention have been described by way of illustration, it will be understood that the invention may be carried out with many variations, modifications, and adaptations, without exceeding the scope of the claims.

The invention claimed is:

1. A ball launcher apparatus comprising:

a ball launcher configured to launch balls, the ball launcher including portability-facilitating bottom wheels at a bottom surface of the ball launcher, and a turning device configured to be connected to and disconnected from the ball launcher via the portability-facilitating bottom wheels, wherein said turning device comprises:

a) a base having a lower surface and side surfaces of the base;

b) a platform connected to the base and configured to rotate about the base while the base is stationary such that the ball launcher rotates as the platform rotates, the platform having an upper surface and side surfaces of the platform to define an interior space of the turning device between the upper surface of the platform and the lower surface of the base and interior to the side surfaces of the platform and base, wherein the upper surface of the platform is formed with a plurality of fixed-volume recessed regions that extend towards the lower surface of the base and are sized to receive and to be secured to, the portability-facilitating bottom wheels of the ball launcher respectively while the ball launcher and the turning device are connected to each other to minimize or eliminate ball launcher slippage during a turning motion;

c) a controlled force generator disposed between the upper surface of the platform and the lower surface of the base without extending outside of the interior space of the turning device, wherein a power source for powering the force generator is connectable thereto; and d) a turning mechanism connected to the controlled force generator and disposed between the upper surface of the platform and the lower surface of the base without extending outside of the interior space of the turning device, the turning mechanism configured to rotate the platform about the base while the base is stationary such that the platform and the ball launcher undergo angular displacement relative to said base, in response to a force transmitted to said turning mechanism by said force generator, to facilitate propulsion of the balls ejected from the ball launcher in varying directions, wherein said turning mechanism is movably connected to said platform and is configured to transmit a force that causes said platform to undergo non-uniform angular motion at a varied rate or at a varied angular displacement, or at a varied rate and at a varied angular displacement, so that the balls being ejected from the ball launcher will appear to be propelled in random directions, wherein the controlled force generator and turning mechanism are protected within the interior space of the turning device between the upper surface of the platform and the lower surface of the base and interior to the side surfaces of the platform and base.

2. The ball launcher apparatus according to claim 1, wherein the platform is configured to undergo angular displacement with respect to the base about a vertically oriented pin movably connecting the platform and the base.

3. The ball launcher apparatus according to claim 2, wherein the turning mechanism:

is also movably connected to the force generator; or is also configured to transmit a force that causes the platform to undergo oscillatory angular displacement; or comprises an elongated link that is pivotally connected at a first end to a vertically oriented shaft driven by the force generator and that is slidably constrained at a second end within a groove formed in the platform that is offset from the shaft to apply a rotation-inducing force.

4. The ball launcher apparatus according to claim 3, wherein the turning mechanism is configured to:

transmit a force that causes said platform to undergo non-uniform angular motion at a varied rate even though the power source provides steady electric power by virtue of a varied distance between the second end of the elongated link and the vertically oriented pin movably connecting the platform and the base.

5. The ball launcher apparatus according to claim 3, wherein the groove is linearly extending and is delimited by first and second parallel walls, a rotational direction of the link defining onto which of the first and second walls is the rotation-inducing force applied thereby and also defining a corresponding turning direction of the platform.

6. The ball launcher apparatus according to claim 1, wherein the force generator is an electric motor.

7. The ball launcher apparatus according to claim 1, wherein one or more contact wheels adapted to be in rolling contact with an underside of the platform are movably mounted to the base to maintain a substantially uniform spacing between the base and platform, while the platform is both stationary and undergoing angular displacement.

8. The ball launcher apparatus according to claim 1, wherein the force generator is an electric motor for transmitting a force to the turning mechanism, and the ball launcher comprises a battery for powering the motor as well as ball launcher components, electrical power being transmittable through a cable extending between, and releasably connected to, the battery and the turning device motor.

9. The ball launcher apparatus according to claim 8, wherein a controller in data communication with the ball launcher components is housed within the ball launcher and comprises a processor configured to transmit control signals needed to initiate a desired ball ejection operation to the motor, through the cable; or the controller is in data communication with a user interface by which desired operating conditions for the motor are settable.

10. The ball launcher apparatus according to claim 9, wherein the turning mechanism has different rotational characteristics during initiation of two subsequent ball ejection operations that are performed in response to first and second different control signals.

11. The ball launcher apparatus according to claim 9, wherein the ball launcher comprises:

i. controlled ball launcher components;

ii. a controller housed in the ball launcher in data communication with the ball launcher components, the controller housed in the ball launcher comprising a processor configured to transmit control signals needed to initiate a desired ball ejection operation; and iii a battery for powering the ball launcher components, wherein the user interface is also in data communication with the controller housed in the ball launcher.

12. The ball launcher apparatus according to claim 11, further comprising at least one communication unit in data communication with the user interface, for receiving operational commands from at least one remote station that produce a training program that is dependent upon coordinated operation of the ball launcher and of the turning device, wherein the at least one communication unit is selected from the group consisting of a Bluetooth device, a WiFi device, a wired communication device, and a combination thereof, and wherein the at least one remote station is selected from the group consisting of a smartphone, a tablet, a computer, a remote controller device having a first section for the ball launcher and a second section for the turning device, and a combination thereof.

13. The ball launcher apparatus according to claim 1, wherein the turning mechanism is configured to cause the platform and the ball launcher to undergo, relative to the base, oscillatory angular displacement, in response to a force transmitted to the turning mechanism by the force generator, to facilitate propulsion of balls ejected from the ball launcher in varying directions.

14. The ball launcher apparatus according to claim 1, wherein the power source is selected from the group consisting of an AC electricity supply system deliverable to a motor by an electrical outlet and a cable connected to the outlet and to the motor, an external battery, and an internal rechargeable battery; or is configured to:

provide steady electric power that is sufficient to start and stop the angular displacement of the platform; or provide a controllable current level; or provides a controllable current level that is sufficient to start and stop the angular displacement of the platform and to control its rotational speed.

15. The ball launcher apparatus according to claim 1, wherein the turning device has a height ranging from one-thirtieth to one-third of a height of the ball launcher.

16. The ball launcher apparatus according to claim 1, wherein the force generator of the turning device is an electric motor and the power source configured to power the motor is also disposed between the upper surface of the platform and the lower surface of the base without extending outside of the interior space of the turning device, wherein the turning device further comprises:

an internal controller which is also disposed between the upper surface of the platform and the lower surface of the base without extending outside of the interior space of the turning device and configured to control operation of the turning device motor; and wherein the ball launcher apparatus further comprises a user interface in data communication with the internal controller by which desired turning device operating conditions are enterable.

* * * * *